US010385503B2

(12) United States Patent
Lukas et al.

(10) Patent No.: US 10,385,503 B2
(45) Date of Patent: Aug. 20, 2019

(54) IRON COMPRISING A VAPORISATION CHAMBER PROVIDED WITH TWO SEPARATE EVAPORATION AREAS

(71) Applicant: ROWENTA WERKE GmbH, Erbach (DE)

(72) Inventors: Andrea Lukas, Offenbach (DE); Bjorn Scheve, Reichelsheim (DE); Dierk Spatz, Erbach (DE)

(73) Assignee: ROWENTA WERKE GMBH, Erbach (DE)

( * ) Notice: Subject to any disclaimer, the term of this patent is extended or adjusted under 35 U.S.C. 154(b) by 0 days.

(21) Appl. No.: 15/767,028

(22) PCT Filed: Oct. 10, 2016

(86) PCT No.: PCT/EP2016/074245

§ 371 (c)(1),
(2) Date: Apr. 9, 2018

(87) PCT Pub. No.: WO2017/064013

PCT Pub. Date: Apr. 20, 2017

(65) Prior Publication Data

US 2019/0062987 A1 Feb. 28, 2019

(30) Foreign Application Priority Data

Oct. 12, 2015 (EP) ..... 15189437

(51) Int. Cl.
*D06F 75/18* (2006.01)
*D06F 75/24* (2006.01)
(Continued)

(52) U.S. Cl.
CPC ..... *D06F 75/18* (2013.01); *D06F 75/20* (2013.01); *D06F 75/24* (2013.01); *H05B 3/42* (2013.01)

(58) Field of Classification Search
CPC ..... D06F 75/00–24; H05B 3/40–42
See application file for complete search history.

(56) References Cited

U.S. PATENT DOCUMENTS 4,180,928 A * 1/1980 Davidson ..... D06F 75/18 38/77.83
4,277,900 A * 7/1981 Gowdy ..... D06F 75/18 38/77.83
(Continued)

FOREIGN PATENT DOCUMENTS

CN 201660791 U 12/2010
ES 2088338 A2 * 8/1996
(Continued)

OTHER PUBLICATIONS

International Preliminary Report on Patentability and the Written Opinion of the International Searching Authority as issued in International Patent Application No. PCT/EP2016/074245, dated Apr. 17, 2018.
(Continued)

*Primary Examiner* — Ismael Izaguirre
(74) *Attorney, Agent, or Firm* — Pillsbury Winthrop Shaw Pittman LLP

(57) ABSTRACT

An iron includes a soleplate, a heating body including a lower face in thermal contact with the soleplate and an upper face at which a vaporization chamber is provided, and a system for injecting water into the chamber including two injection openings that simultaneously inject water onto two separate evaporation areas of a bottom wall of the chamber when the soleplate is arranged horizontally. The chamber is bordered laterally by a side wall extending from the bottom wall to a closing cover attached to the heating body, the side wall including a passage establishing communication between the chamber and a steam distribution circuit leading to a steam outlet opening provided in the soleplate. The
(Continued)

passage is provided at one longitudinal end of the chamber. The chamber includes a separation wall extending from the two evaporation areas to the passage to provide a partition between the two evaporation areas.

22 Claims, 3 Drawing Sheets

(51) Int. Cl.
*D06F 75/20* (2006.01)
*H05B 3/42* (2006.01)

(56) References Cited

U.S. PATENT DOCUMENTS 5,367,799 A * 11/1994 Wilson ..... D06F 75/20 219/254
5,628,131 A * 5/1997 Chasen ..... D06F 75/18 38/77.83
5,704,143 A * 1/1998 Kubicz ..... D06F 75/18 38/77.83
5,718,071 A * 2/1998 Zbriger ..... D06F 75/18 38/77.83
6,209,239 B1 * 4/2001 Archer ..... D06F 75/18 38/77.83

FOREIGN PATENT DOCUMENTS

FR 2 849 453 A1 7/2004
GB 2 117 012 A 10/1983
JP 2005-224272 A 8/2005

OTHER PUBLICATIONS

International Search Report as issued in International Patent Application No. PCT/EP2016/074245, dated Dec. 21, 2016.

* cited by examiner

IRON COMPRISING A VAPORISATION CHAMBER PROVIDED WITH TWO SEPARATE EVAPORATION AREAS

CROSS-REFERENCE TO RELATED APPLICATIONS

This application is the U.S. National Stage of PCT/EP2016/074245, filed Oct. 10, 2016, which in turn claims priority to European patent application number 15189437.5 filed Oct. 12, 2015. The content of these applications are incorporated herein by reference in their entireties.

This invention concerns the field of irons comprising a flat ironing soleplate, a heating body comprising a lower face in thermal contact with the soleplate and an upper face at which a vaporization chamber is provided. The invention relates more particularly to an iron comprising means for injecting water into the vaporization chamber comprising at least two injection openings that simultaneously inject water onto two separate evaporation areas of a bottom wall of the vaporization chamber when the soleplate of the iron is arranged horizontally.

From the utility model CN201660791U, we know of an iron comprising a flat ironing soleplate surmounted by a heating body comprising an upper face provided with a vaporization chamber, the iron comprising three injection openings that simultaneously inject water onto three separate areas of the vaporization chamber. Such a construction permits better distribution of water onto the surface of the bottom wall of the vaporization chamber when the iron is held horizontally, which improves evaporation.

However, the construction of the vaporization chamber presented in that document has the disadvantage of being particularly bulky, such that it cannot be used on a compact iron, such as a travel iron. In addition, when the iron is held vertically, the water injected through the openings may directly escape through passage openings provided at the top of the walls forming the separation between the various vaporization areas, such that water is able to escape through steam outlet holes without having been vaporized.

The following invention aims to remedy these disadvantages by proposing in particular an iron provided with a vaporization chamber having a particularly compact construction and which ensures complete evaporation of the water injected in the vaporization chamber, regardless of the orientation, horizontal or vertical, of the iron.

The goal of the invention is achieved with an iron comprising a flat ironing soleplate, a heating body comprising a lower face in thermal contact with the soleplate and an upper face at which a vaporization chamber is provided, and means for injecting water into the vaporization chamber comprising at least two injection openings that simultaneously inject water onto two separate evaporation areas of a bottom wall of the vaporization chamber when the soleplate of the iron is arranged horizontally, the vaporization chamber being bordered laterally by a side wall extending from the bottom wall to a closing cover attached to the heating body, the side wall comprising at least one passage establishing communication between the vaporization chamber and a steam distribution circuit leading to at least one steam outlet opening provided in the soleplate, characterized in that the passage is provided at one longitudinal end of the vaporization chamber and in that the vaporization chamber comprises a separation wall extending from the two evaporation areas to the passage so as to provide a partition between the two evaporation areas.

The separation wall thus created has the advantage of extending on the full height of the vaporization chamber, from the bottom wall to the closing cover, and on the entire length of the vaporization chamber, from the two evaporation areas to the communication passage provided in the side wall, such that the water injected in either of the two evaporation areas cannot be transferred directly by gravity to the other evaporation area when the soleplate of the iron is oriented horizontally or vertically.

This achieves better distribution of the water sprayed onto the different surfaces of the vaporization chamber that are able to vaporize the water.

According to another characteristic of the invention, the shape of the side wall and the separation wall is adapted so that the water injected through one of the two injection openings falls by gravity onto the separation wall, while the water injected through the other injection opening falls by gravity onto the side wall when the soleplate of the iron is arranged vertically according to any angular orientation.

This characteristic makes it possible to optimize the vaporization of the water injected into the vaporization chamber when the iron is held vertically, regardless of its angular orientation in the vertical plane. In fact, the water injected into the vaporization chamber is then distributed equitably between the surfaces of the side wall and the surfaces of the separation wall, each of these surfaces then acting as a vaporization surface.

According to another characteristic of the invention, the heating body comprises at least one electric heating resistor, and preferably two electric heating resistors.

According to another characteristic of the invention, the iron comprises a first U-shaped to electric heating resistor with two branches extending to the periphery of the heating body, and a second U-shaped electric heating resistor extending between the branches of the first electric heating resistor.

Preferably, the power of the first electric heating resistor is approximately 900 W, and the power of the second electric heating resistor is approximately 550 W.

According to another characteristic of the invention, the separation wall extends over or along an electric heating resistor.

Such a characteristic permits obtaining excellent thermal transfer between the heating resistor and the separation wall, such that the surfaces of the separation wall can quickly vaporize any water droplet that comes into contact with them.

According to another characteristic of the invention, the vaporization chamber has the general shape of a U and includes a central portion where water is injected through the injection openings, and two longitudinal ends where a passage is provided to establish communication with the steam distribution circuit.

Such a characteristic permits obtaining a particularly compact vaporization chamber offering very good vaporization performance.

According to another characteristic of the invention, the heating body comprises a thermostatic device arranged outside the vaporization chamber, in a location provided between the U-shaped branches of the vaporization chamber.

Such a characteristic permits retaining a compact heating body in which the thermostatic device is arranged as close as possible to the vaporization chamber, permitting very great responsiveness to temperature changes in the vaporization chamber.

According to yet another characteristic of the invention, the separation wall has the general shape of a U and is arranged roughly midway between a first part of the side wall, in the shape of a U, which delimits the front part of the vaporization chamber, and a second part of the side wall, also in the shape of a U, which delimits the back part of the vaporization chamber.

According to yet another characteristic of the invention, the distribution circuit comprises a U-shaped channel laterally surrounding the vaporization chamber, the channel comprising a front end that includes an opening going through the heating body and leading to the lower face of the heating body.

According to yet another characteristic of the invention, the steam distribution circuit comprises a diffusion chamber provided on the lower face of the heating body, the diffusion chamber comprising a rib, coming into contact with the soleplate, that channels the steam to the back of the heating body and forces it to travel along the lateral edge of the heating body before exiting from the steam outlet opening of the soleplate.

According to yet another characteristic of the invention, the soleplate comprises a pointed front end.

According to yet another characteristic of the invention, the shape of the side wall and the separation wall is adapted so that the total surface area of the side wall and the separation wall onto which the water injected through the two injection openings falls by gravity when the iron is held vertically, is substantially equal to the surface area of the bottom wall onto which the water falls by gravity when the iron is held horizontally.

Such a characteristic permits obtaining a particularly compact vaporization chamber that achieves substantially equivalent performances when the iron is held horizontally or vertically.

According to another characteristic of the invention, the iron comprises a housing that includes a gripping handle overhanging the soleplate, the gripping handle including a free back end supporting a power cord.

Such a characteristic has the advantage of making the iron very easy to handle, whether it is being used horizontally or vertically.

The invention also relates to a device comprising an iron as previously described and a base connected by a cord to the iron, characterized in that the base includes a water reservoir and an electric pump to permit sending water from the reservoir to the injection openings of the iron.

The objects, aspects, and advantages of this invention will be more fully understood in consideration of the following description of a particular embodiment of the invention presented as a non-restrictive example, by referring to the attached drawings in which FIG. 1 is a perspective view of an iron according to a particular embodiment of the invention;

Only the elements necessary for understanding the invention have been represented. To facilitate reading of the drawings, the same elements bear the same references from one figure to the next.

Figure 1:
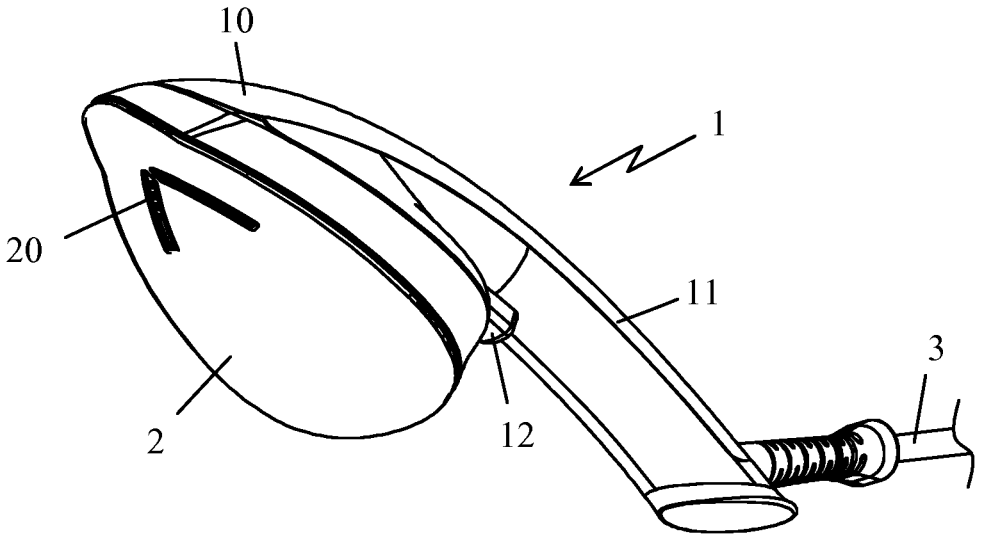

FIG. 1 represents an iron 1 comprising a flat soleplate 2 provided with steam outlet holes 20, the soleplate 2 being surmounted by a plastic housing 10 that includes a gripping handle 11 overhanging the back end of the soleplate 2, the gripping handle 11 including a free back end connected by a cord 3 to a base (not shown in the figure) containing a reservoir.

The soleplate 2 is made of stainless steel and includes a pointed front end arranged to opposite the gripping handle 11, as well as a rounded back end that is wider, the soleplate 2 having reduced dimensions in order to make the iron 1 easy to handle.

For example, the soleplate 2 has a length of less than 15 cm, and advantageously of approximately 14 cm, and a width of less than 10 cm, and advantageously of approximately 8 cm, the gripping handle 11 laterally projecting over a length of approximately 12 cm.

Figure 2:
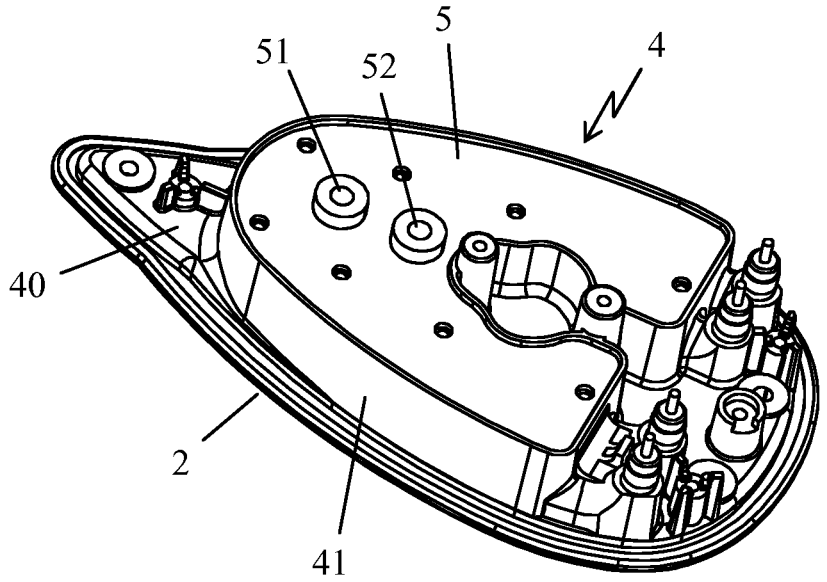
FIG. 2 is a perspective view of the heating body and of the soleplate equipping the iron in FIG. 1.
Figure 3:
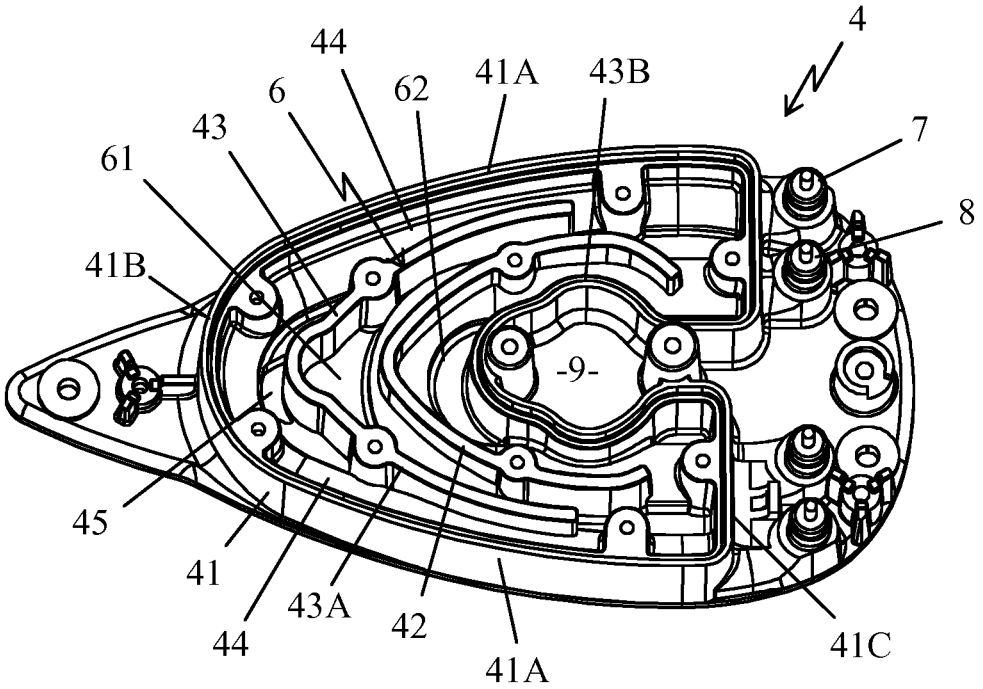
FIG. 3 is a perspective view of the top of the heating body in FIG. 2, without its cover plate.
Figure 4:
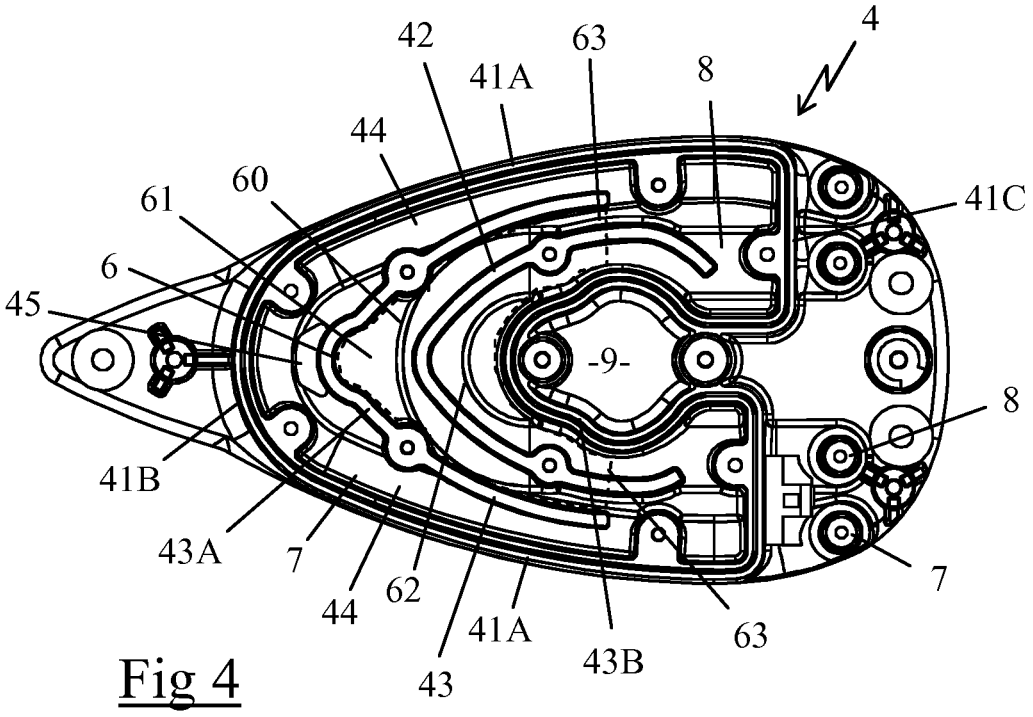
FIG. 4 is a view of the top of the heating body in FIG. 3.

According to FIGS. 2 to 4, the housing 10 of the iron 1 contains a heating body 4 that is in thermal contact with the soleplate 2, the heating body 4 including a casting 40, advantageously made of aluminum, that includes a surface area where a peripheral wall 41 projects vertically at a height of approximately 14 mm. The heating body 4 also comprises a closing cover 5, visible in FIG. 2, that rests on the peripheral wall 41 by being connected in a sealing manner to the latter.

The peripheral wall 41 and the closing cover 5 define a volume in which are provided an instant vaporization chamber 6, the contour of which is illustrated in dotted lines on FIG. 4, and a steam distribution circuit connecting the vaporization chamber 6 to the steam outlet holes 20 of the soleplate 2.

As can be seen on FIG. 4, the peripheral wall 41 comprises two side parts 41A that extend at the border of the lateral edges of the heating body 4, and comprises a rounded front part 41B, set back slightly from a front point of the casting 40 in contact with the pointed front end of the soleplate 2, as well as a back part 41C comprising two flat side parts arranged on both sides of a central part in the shape of a horseshoe, extending toward the front of the heating body 4.

Preferably, the heating body 4 encloses a first electric heating resistor 7 and a second electric heating resistor 8, each including two connecting ends leading close to the back end of the heating body 4, outside of the volume defined by the peripheral wall 41.

The first heating resistor 7 has the general shape of a U and extends along the side parts 41A and front part 41B of the peripheral wall 41. This first heating resistor 7 advantageously has a power of approximately 925 W.

The second electric heating resistor 8 has the general shape of a U, smaller in size compared to the first heating resistor 7, the second heating resistor 8 extending inside the branches of the first heating resistor 7 and being arranged substantially parallel to the latter. The second heating resistor 8 advantageously has a power of approximately 545 W.

The vaporization chamber 6 is provided in the central part of the heating body 4 and includes a bottom wall 60 at which are provided two different evaporation areas 61, 62 separated from one another by a separation wall 42, the vaporization chamber 6 being bordered by a side wide 43 extending from the bottom wall 60 to the closing cover 5.

The side wall 43 of the vaporization chamber 6 includes a first part 43A in the shape of a U which delimits the front part of the vaporization chamber 6 and which is advantageously arranged in the area of the bottom wall 60 extending between the first and second heating resistors 7, 8.

The side wall 43 of the vaporization chamber 6 also comprises a second part 43B in the shape of a U which delimits the back part of the vaporization chamber 6, this second part 43B being included between the branches of the U of the first part 43A of the side wall 43. Preferably, the second part 43B of the side wall 43 of the vaporization chamber 6 extends at the border of the second resistor 8, inside the latter, and consists of a portion of the back part 41C of the peripheral wall 41, such a construction making it possible to obtain an extremely compact heating body 4.

The first and second resistors are adjusted using a thermostat, not illustrated on the figures, arranged in a location 9 provided between the U-shaped branches of the second part 43B of the side wall 43, this thermostat making it possible to keep the vaporization chamber 6 around a set-point temperature of approximately 150° C. which is preferably not adjustable by the user.

Preferably, the flow area of the vaporization chamber 6 gradually diminishes from its central part to the passages 63 provided at the two longitudinal ends of the vaporization chamber 6 where the steam is released in the distribution circuit, the distance between the first part 43A and the second part 43B of the side wall 43 being approximately 2.5 cm at the central part and gradually diminishing until a distance of approximately 1 cm is achieved at the passages 63.

The separation wall 42 extends to roughly midway between the first and second parts 43A, 43B of the side wall 43 of the vaporization chamber 6 and continues beyond the passages 63 by following the curve of the back part 41C of the peripheral wall 41. This separation wall follows the U-shaped path of the second heating resistor 8, being arranged over the later, so that it is kept at a high temperature by the heat released from the second heating resistor 8.

The vaporization chamber 6 thus made has the general shape of a U, centered on the longitudinal axis of the heating body 4, which communicates with the steam distribution circuit through the passages 63 provided at its two longitudinal ends, the steam distribution circuit comprising a channel 44 in the shape of a U comprising branches extending at the periphery of the vaporization chamber 6.

Figure 5:
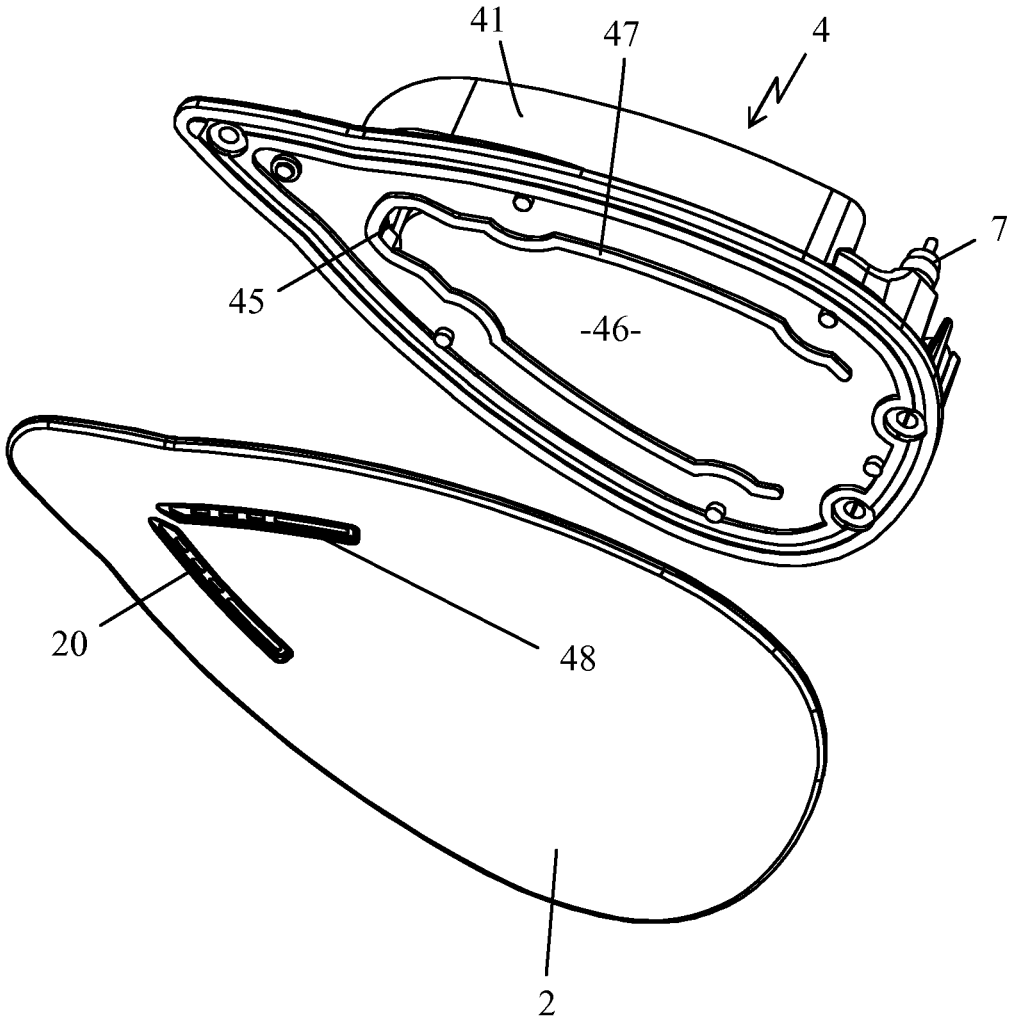
FIG. 5 is an exploded perspective view of the heating body and of the soleplate in FIG. 2.

According to FIGS. 4 and 5, the channel 44 includes two back ends communicating with the passages 63 provided at the longitudinal ends of the vaporization chamber 6 and comprises a front end that includes an opening 45 going through the bottom wall 60 to establish communication with a steam diffusion chamber 46 provided on the lower face of the heating body 4.

As can be seen on FIG. 5, the steam diffusion chamber 46 extends substantially on the entire surface of the lower face of the heating body 4, and contains a rib 47 in the shape of a U which follows the interior contour of the first heating resistor 7. The rib 47 comes into contact with the soleplate 2 when the latter is assembled on the heating body 4 and thus contributes to the thermal transfer from the heating body 4 to the soleplate 2, the temperature of the soleplate 2 being advantageously kept below 135° C. during operation of the iron 1 because of thermal losses between the vaporization chamber 6 and the soleplate 2.

The rib 47 thus made channels the steam to the back of the heating body 4 and forces the steam to travel along the lateral edge of the heating body 4, that is, below the first heating resistor 7, before being able to escape through the steam outlet holes 20, the latter holes leading to two grooves 48 arranged in a V shape on the front part of the soleplate 2.

According to FIG. 2, the vaporization chamber 6 is supplied with water by two different injection openings 51, 52 provided in the closing cover 5, the two injection openings 51, 52 being arranged on the longitudinal axis of the heating body 4 and leading directly over the two evaporation areas 61, 62, respectively, of the vaporization chamber 6 when the soleplate 2 of the iron 1 is arranged horizontally.

These two injection openings 51, 52 are supplied with water by means of a pump, not shown in the figures, which is integrated in the base and whose operation is controlled with a trigger 12 arranged below the front end of the gripping handle 11, the pump advantageously having a flow of approximately 25 gr/min when the trigger 12 is activated.

The iron 1 thus made has the advantage of being very compact while integrating a vaporization chamber 6 permitting a significant flow of steam, approximately 25 gr/min, regardless of the vertical or horizontal orientation of the soleplate 2.

In fact, the water injected by the pump through the two injection openings 51, 52 is sprayed either onto the two evaporation areas 61, 62 of the bottom wall 60, when the iron is held horizontally, or onto the side wall 43 and the separation wall 42 when the iron 1 is held vertically.

However, the surface of the bottom wall 60 which defines the two evaporation areas 61, 62 has the advantage of being in the immediate proximity of the heating resistors 7, 8 such that these two evaporation areas 61, 62 are permanently maintained at a high temperature, ensuring a high level of vaporization of the water injected through the injection openings 51, 52 when the iron 1 is arranged horizontally.

Likewise, when the iron 1 is arranged vertically, the water injected through the two injection openings 51, 52 is sent to two separate walls, consisting of the side wall 43 of the vaporization chamber 6 and the separation wall 42, regardless of the orientation of the front point of the soleplate 2 of the iron 1.

Thus, the water injected through the two injection openings 51, 52 comes into contact with the two different walls 42, 43 in the immediate proximity of the first and second heating resistors 7, 8 such that these two walls 42, 43 are permanently maintained at a high temperature, ensuring immediate vaporization of the water injected through the injection openings 51, 52 when the iron 1 is arranged vertically.

In particular, the shape and orientation of the side wall 43 and of the separation wall 42 prevent the water injected through the injection openings 51, 52 from exiting directly from the opening 45 without coming into contact with the superheated walls 42, 43, such that there is no risk that the water injected through the openings will flow directly through the opening 45 without coming into contact with the side wall 43 or separation wall 42 of the vaporization chamber 6.

In addition, any water droplets that may be carried by the flow of steam outside the vaporization chamber 6 are gradually vaporized when they successively travel to the channel 44 of the distribution circuit provided over the first heating resistor 7 and then to the steam diffusion chamber 46 provided under the heating body 4.

Finally, in such an iron 1, the surface of the side wall and/or separation wall onto which the water coming from the injection openings 51, 52 is sprayed when the soleplate 2 of the iron 1 is oriented vertically, substantially corresponds to the surface of the evaporation areas 61, 62 of the bottom wall 60 onto which the water coming from the injection openings 51, 52 is sprayed when the soleplate 2 of the iron 1 is oriented horizontally, such that the vaporization chamber 6 produces substantially the same flow of steam whether the iron 1 is used horizontally or vertically.

In this way, we obtain a particularly compact iron, which is thus very easy to handle, procuring a flow of steam of approximately 25 gr/min regardless of the horizontal or vertical orientation of the soleplate of the iron, permitting the user to do ironing jobs equally whether the iron 1 is used horizontally on an ironing board or vertically, like a steaming brush.

Of course, the invention is in no way limited to the embodiment described and illustrated, which has been provided only as an example. Modifications are still possible, in particular from the point of view of composition of the various components or by substitution of equivalent techniques, without departing from the scope of protection of the invention.

Thus, in an embodiment variant not represented, the iron may comprise even more evaporation areas separated from one another by separation walls and supplied by at least one dedicated injection opening.

Thus, in yet another embodiment variant not represented, the injection openings may be replaced with nozzles to spray a water mist in the vaporization chamber in order to further encourage the evaporation speed.

The invention claimed is:

1. Iron comprising a flat ironing soleplate, a heating body comprising a lower face in thermal contact with the soleplate and an upper face at which a vaporization chamber is provided, and means for injecting water into the vaporization chamber comprising at least two injection openings that simultaneously inject water onto two separate evaporation areas of a bottom wall of the vaporization chamber when the soleplate of the iron is arranged horizontally, the vaporization chamber being bordered laterally by a side wall extending from the bottom wall to a closing cover attached to the heating body, the side wall comprising at least one passage establishing communication between the vaporization chamber and a steam distribution circuit leading to at least one steam outlet opening provided in the soleplate, the at least one passage being provided at one longitudinal end of the vaporization chamber and the vaporization chamber comprising a separation wall extending from the two evaporation areas to the at least one passage so as to provide a partition between the two evaporation areas that prevents the water injected in either one of the two evaporation areas from being transferred directly by gravity to the other one of the two evaporation areas when the soleplate is arranged horizontally or vertically, wherein a shape of the side wall and a shape of the separation wall are adapted so that the water injected through one of the at least two injection openings falls by gravity onto the separation wall, while the water injected through the other injection opening falls by gravity onto the side wall when the soleplate of the iron is arranged vertically according to any angular orientation.

2. The iron according to claim 1, wherein the heating body includes at least one electric heating resistor.

3. The iron according to claim 2, further comprising a first U-shaped electric heating resistor that has two branches extending to a periphery of the heating body and a second U-shaped electric heating resistor extending between the two branches of the first electric heating resistor.

4. The iron according to claim 2, wherein the separation wall extends over or along an electric heating resistor.

5. The iron according to claim 1, wherein the vaporization chamber has the general shape of a U and includes a central portion where water is injected through the at least two injection openings and two longitudinal ends where the at least one passage is provided to establish communication with the steam distribution circuit.

6. The iron according to claim 5, wherein the separation wall has the general shape of a U and is arranged roughly midway between a first part of the side wall, in the shape of a U, which delimits the front part of the vaporization chamber, and a second part of the side wall, also in the shape of a U, which delimits the back part of the vaporization chamber.

7. The iron according to claim 5, wherein the steam distribution circuit comprises a U-shaped channel laterally surrounding the vaporization chamber, the U-shaped channel comprising a front end that includes an opening going through the heating body and leading to the lower face of the heating body.

8. The iron according to claim 7, wherein the steam distribution circuit comprises a diffusion chamber provided on the lower face of the heating body, and wherein the diffusion chamber comprises a rib coming into contact with the soleplate, that channels the steam to the back of the heating body and forces it to travel along a lateral edge of the heating body before exiting from the at least one steam outlet opening of the soleplate.

9. The iron according to claim 1, wherein the soleplate comprises a pointed front end.

10. The iron according to claim 1, wherein the shape of the side wall and the shape of the separation wall are adapted so that a total surface area of the side wall and the separation wall onto which the water injected through the at least two injection openings falls by gravity when the iron is held vertically, is substantially equal to a surface area of the bottom wall onto which the water falls by gravity when the iron is held horizontally.

11. The iron according to claim 1, wherein the iron comprises a housing that includes a gripping handle overhanging the soleplate, the gripping handle including a free back end supporting a power cord.

12. Device comprising an iron according to claim 1, and a base connected by a cord to the iron, wherein the base includes a water reservoir and an electric pump to permit sending water from the reservoir to the at least two injection openings of the iron.

13. The iron according to claim 2, wherein the heating body includes two electric heating resistors.

14. The iron according to claim 1, wherein the water injected into the vaporization chamber is distributed equitably between surfaces of the side wall and surfaces of the separation wall.

15. Iron comprising a flat ironing soleplate, a heating body comprising a lower face in thermal contact with the soleplate and an upper face at which a vaporization chamber is provided, and means for injecting water into the vaporization chamber comprising at least two injection openings that simultaneously inject water onto two separate evaporation areas of a bottom wall of the vaporization chamber when the soleplate of the iron is arranged horizontally, the heating body including two electric heating resistors, the vaporization chamber being bordered laterally by a side wall extending from the bottom wall to a closing cover attached to the heating body, the side wall comprising at least one passage establishing communication between the vaporization chamber and a steam distribution circuit leading to at least one steam outlet opening provided in the soleplate, the at least one passage being provided at one longitudinal end of the vaporization chamber and the vaporization chamber comprising a separation wall extending from the two evaporation areas to the at least one passage so as to provide a partition between the two evaporation areas, wherein a shape of the side wall and a shape of the separation wall are adapted so that the water injected through one of the at least two injection openings falls by gravity onto the separation wall, while the water injected through the other injection opening falls by gravity onto the side wall when the soleplate of the iron is arranged vertically according to any angular orientation.

16. The iron according to claim 15, wherein the heating body comprises a first U-shaped electric heating resistor that has two branches extending to a periphery of the heating body and a second U-shaped electric heating resistor extending between the two branches of the first electric heating resistor.

17. The iron according to claim 15, wherein the separation wall extends over or along one of the electric heating resistors.

18. The iron according to claim 15, wherein the vaporization chamber, the separation wall, and the side wall each have a general shape of a U.

19. Iron comprising a flat ironing soleplate, a heating body comprising a lower face in thermal contact with the soleplate and an upper face at which a vaporization chamber is provided, and means for injecting water into the vaporization chamber comprising at least two injection openings that simultaneously inject water onto two separate evaporation areas of a bottom wall of the vaporization chamber when the soleplate of the iron is arranged horizontally, the vaporization chamber having a general shape of a U and including a central portion where water is injected through the at least two injection openings and two longitudinal ends, the vaporization chamber further being bordered laterally by a first side wall and a second side wall each extending from the bottom wall to a closing cover attached to the heating body and each of the first side wall and the second side wall comprising a portion in the shape of a U, at least one passage establishing communication between the vaporization chamber and a steam distribution circuit leading to at least one steam outlet opening provided in the soleplate, the at least one passage being provided at one longitudinal end of the vaporization chamber and the vaporization chamber comprising a separation wall extending from the two evaporation areas to the at least one passage so as to provide a partition between the two evaporation areas, wherein the side wall and the separation wall are adapted so that the water injected through one of the at least two injection openings falls by gravity onto the separation wall, while the water injected through the other injection opening falls by gravity onto the side wall when the soleplate of the iron is arranged vertically according to any angular orientation, and wherein the separation wall has the general shape of a U and is arranged roughly midway between the first side wall which delimits the front part of the vaporization chamber and a second part of the side wall which delimits the back part of the vaporization chamber.

20. The iron according to claim 19, wherein the steam distribution circuit comprises a U-shaped channel laterally surrounding the vaporization chamber, the U-shaped channel comprising a front end that includes an opening going through the heating body and leading to the lower face of the heating body.

21. The iron according to claim 19, wherein the steam distribution circuit comprises a diffusion chamber provided on the lower face of the heating body, and wherein the diffusion chamber comprises a rib coming into contact with the soleplate, that channels the steam to the back of the heating body and forces it to travel along a lateral edge of the heating body before exiting from the at least one steam outlet opening of the soleplate.

22. Iron comprising a flat ironing soleplate, a heating body comprising a lower face in thermal contact with the soleplate and an upper face at which a vaporization chamber is provided, and a water injection system adapted to inject water into the vaporization chamber, the water injection system comprising at least two injection openings that simultaneously inject water onto two separate evaporation areas of a bottom wall of the vaporization chamber when the soleplate of the iron is arranged horizontally, the vaporization chamber being bordered laterally by a side wall extending from the bottom wall to a closing cover attached to the heating body, the side wall comprising at least one passage establishing communication between the vaporization chamber and a steam distribution circuit leading to at least one steam outlet opening provided in the soleplate, the vaporization chamber comprising a separation wall extending from the two evaporation areas to the at least one passage so as to provide a partition between the two evaporation areas, wherein a shape of the side wall and a shape of the separation wall are adapted so that the water injected through one of the at least two injection openings falls by gravity onto the separation wall, while the water injected through the other injection opening falls by gravity onto the side wall when the soleplate of the iron is arranged vertically according to any angular orientation, and wherein the at least one passage is provided at one longitudinal end of the vaporization chamber such that steam produced in either one of the two evaporation areas escapes through the at least one passage without passing through the other one of the two evaporation areas.

* * * * *